US007255302B2

(12) United States Patent
Shearer et al.

(10) Patent No.: US 7,255,302 B2
(45) Date of Patent: Aug. 14, 2007

(54) GUIDE APPARATUS FOR CONTINUOUS FIBER BUNDLE, WINDING MACHINE FOR CONTINUOUS FIBER BUNDLE EQUIPPED WITH THE GUIDE APPARATUS, METHOD FOR MAKING BOBBIN BY THE WINDING MACHINE, AND CARBON FIBER BOBBIN MADE BY THE METHOD

(75) Inventors: Gordon Shearer, Sacramento, CA (US); Fumihiko Nobayashi, Sacramento, CA (US); Osamu Tsutsumi, Hiroshima (JP); Atsushi Kawamura, Hiroshima (JP)

(73) Assignee: Mitsubishi Rayon Co., Ltd., Tokyo (JP)

( * ) Notice: Subject to any disclaimer, the term of this patent is extended or adjusted under 35 U.S.C. 154(b) by 0 days.

(21) Appl. No.: 10/796,064

(22) Filed: Mar. 10, 2004

(65) Prior Publication Data

US 2005/0199760 A1 Sep. 15, 2005

(51) Int. Cl.
*B65H 57/16* (2006.01)

(52) U.S. Cl. ..... 242/615.21

(58) Field of Classification Search ..... 242/413, 242/615.21, 615.12, 615.1, 615, 471; 226/189, 226/18, 19, 118.1, 118.2, 109, 110
See application file for complete search history.

(56) References Cited

U.S. PATENT DOCUMENTS

| | | | | |
|---|---|---|---|---|
| 3,997,122 | A * | 12/1976 | Helfand et al. | 242/160.2 |
| 4,600,161 | A * | 7/1986 | Barboza | 242/471 |
| 4,989,799 | A * | 2/1991 | Nakai et al. | 242/472.8 |
| 5,487,512 | A * | 1/1996 | Nojiri et al. | 242/471 |
| 5,489,067 | A * | 2/1996 | Nakai et al. | 242/474.5 |
| 5,499,776 | A * | 3/1996 | Nojiri et al. | 242/178 |
| 5,881,939 | A * | 3/1999 | Kikuchi et al. | 226/180 |

FOREIGN PATENT DOCUMENTS

| | | | |
|---|---|---|---|
| EP | 0 459 681 A1 | | 12/1991 |
| JP | 58212564 A | * | 12/1983 |
| JP | 4-119123 | | 4/1992 |
| JP | 10330038 A | * | 12/1998 |
| JP | 2001-348166 | | 12/2001 |

OTHER PUBLICATIONS

Translation of previously cited foriegn document JP10-330038-A.*
Patent Abstracts of Japan, JP 10-330038, Dec. 15, 1998 (submitting English Abstract only; previously cited by the Examiner on Jul. 14, 2005.

* cited by examiner

*Primary Examiner*—Patrick Mackey
*Assistant Examiner*—William E. Dondero
(74) *Attorney, Agent, or Firm*—Oblon, Spivak, McClelland, Maier & Neustadt, P.C.

(57) ABSTRACT

Disclosed are guide apparatus for guiding an advancing continuous fiber bundle, a winding machine having the guide apparatus installed therein, a method for making a bobbin of a continuous fiber bundle, particularly that of carbon fibers, and a carbon fiber bobbin made by using the winding machine; and the guide apparatus comprises:

a pair of a first and a second guides disposed on the passage of the fiber bundle, axis lines of which guides are in a relation twisted away from each other in a space, and a parallel guide disposed at the downstream side of the pair of the guides, axis line of which parallel guide is parallel to that of the bobbin, the first guide being a flat or a conical guide, and the second guide being a conical guide.

14 Claims, 6 Drawing Sheets

GUIDE APPARATUS FOR CONTINUOUS FIBER BUNDLE, WINDING MACHINE FOR CONTINUOUS FIBER BUNDLE EQUIPPED WITH THE GUIDE APPARATUS, METHOD FOR MAKING BOBBIN BY THE WINDING MACHINE, AND CARBON FIBER BOBBIN MADE BY THE METHOD

BACKGROUND OF THE INVENTION

1. Technical Field of the Invention

The present invention relates to a guide apparatus for guiding an advancing continuous fiber bundle, a winding machine for winding the fiber bundle on a bobbin, a method for making a bobbin of a continuous fiber bundle, and the bobbin itself. Specifically, the present invention relates to a winding machine for winding a tape-like fiber bundle having a widened flat cross section on a bobbin and to a bobbin of a continuous bundle of carbon fibers. Further, the present invention relates to a winding machine which is equipped with the guide apparatus and by which a tape-like fiber bundle as a reinforcement can stably be wound on a bobbin in a state wherein the widened flat cross section is maintained.

2. Description of Related Art

As a reinforcement for fiber reinforced composite materials, carbon fibers, glass fibers, aramid (aromatic polyamide) fibers have been used. Among them, carbon fibers have been employed as reinforcement in the uses for aircrafts, sporting-goods such as golf shafts and fishing rods, and supplies in general industries, since the carbon fibers are excellent in specific strength, specific modulus, thermal resistance, and resistance to chemicals. In order to obtain carbon fibers having a high strength and a high modulus, a fiber bundle of carbon fiber precursors which is small in fiber breakage and fluff occurrence, and excellent in qualities is required. Heretofore, as the fiber bundle of precursors, that comprising 3,000 to 24,000 filaments has mainly been employed.

In recent years, carbon fibers came to widely be used up to general industrial uses such as construction, civil engineering, automobiles, energy, and compounds, and thus, so called large tows comprising more than 24,000 filaments having a high strength and a high modulus, and excellent in productivity have strongly been demanded. Carbon fibers are infrequently used only by themselves from the view points of their shapes and other characteristics. In many cases, carbon fibers are impregnated with a resin such as an epoxy resin after a plurality of fiber bundles were arranged in parallel to each other to prepare impregnated fiber bundles (this is generally called as a prepreg), wound into a cylindrical shape or put on a molded product to be covered, and then heated to cure the resin thereby obtain a fiber reinforced plastic molded product as final product.

Since the carbon fibers are light in weight and have a high strength compared with other reinforcing fiber materials, research and investigation have been conducted for further reducing the weight even of a prepreg prepared by impregnating carbon fibers with an epoxy resin to further taking advantage of such characteristics of carbon fibers.

In order to reduce the weight per unit area of a carbon fiber prepreg, it is necessary to widen the carbon fiber bundles to thin, and thus various plans have been elaborated by carbon fiber manufacturers now producing prepregs.

However, if the width of the fiber bundle as a reinforcement, such as carbon fiber bundle supplied at a step for preparing a prepreg was increased in advance up to a certain width, that is, if the fiber bundle as a reinforcement wound on a bobbin was in a shape of widened tape-like fiber bundles, it is possible to omit the work for increasing the width of the fiber bundles at a step of preparing a prepreg. Accordingly, a case wherein a widened tape-like fiber bundle as a reinforcement wound on a bobbin is used for preparing a light stuff prepreg has recently been increased.

Further, in recent years, the application of a bundle comprising a large number of carbon fiber filaments to various molding methods such as drum winding, filament winding, and pultrusion molding has been attempted for preparing a prepreg. Even in these methods for preparing a prepreg, the fiber bundle is preferably in a shape of a widened tape and more desirably in a shape of a fiber bundle which is small in twisting and variation of width.

Such a tape-like bundle of carbon fibers can be produced by impregnating a bundle of carbon fibers with a sizing agent containing an epoxy resin as main component at a last step for preparing carbon fibers, squeezing the impregnated fiber bundle with nip rolls or contacting the impregnated fiber bundle with a dry heated roll to increase its width, and then drying the widened bundle. The tape-like bundle of carbon fibers thus prepared has, as a final product, a shape of a roll wound on a bobbin.

In winding apparatuses, a fiber bundle is traversed in the direction parallel to the axis of a bobbin so that the fiber bundle is uniformly wound in the lengthwise direction of the bobbin. In such existing winding apparatuses, however, consideration is not given to the maintenance of the shape of a tape-like fiber bundle. Accordingly, in a case wherein a widened fiber bundle is wound on a bobbin by employing a winding apparatus designed for general fibers, when a general purpose guide specified by a manufacturer for general fibers was used, the fiber bundle is pressed in the crosswise direction to converge or twisted in the direction of the axis of a bobbin at the time when the fiber bundle is traversed. As a result, the widened tape-like fiber bundle is wound on a bobbin in a state wherein the shape of widened tape-like the fiber bundle was lost, and thus it becomes impossible to apply the winding apparatus to such a purpose preparing a light stuff prepreg as described above.

Then, a proposal has been advanced for winding a widened tape-like fiber bundle on a bobbin by using an existing winding apparatus while maintaining its flat shape. Heretofore, a method in which a guide apparatus is installed as traverse guide in an existing winding apparatus as described, for example, in Laid-open Japanese Patent Publication No. Hei 4-119123 and Laid-open Japanese Patent Publication No. Hei 10-330038 has been proposed.

The guide apparatus described in the Laid-open Japanese Patent Publication No. Hei 4-119123 has a fixed stand for a plate-like yam guide which stand is stood up at a right angle with a traverse arm disposed in parallel to the axis of a bobbin and slid along the traverse arm, and guide rolls for guiding a fiber bundle are disposed above and below the fixed stand yarn guide. The lower guide roll is composed of a single roll disposed in parallel to the axis of a take-up bobbin, and the guide roll disposed above the fixed stand for the yam guide is composed of a pair of parallel guide rolls crossing at right angle with the axial line of the take-up bobbin. While a widened fiber bundle is twisted 90° toward the direction of the axis line of the bobbin between the upper and lower guide rolls, the tape-like fiber bundle can be wound on the bobbin in a state wherein its widened shape is still maintained by passing the fiber bundle through the upper and lower guide rolls.

On the other hand, the guide apparatus described in the Laid-open Japanese Patent Publication No. Hei 10-330038 mentioned above has an upper and a lower cone guides, axial lines of which cross at right angle with each other, disposed above a plate member stood up at right angle with a traverse arm and reciprocatively moved along a traverse arm, and has additionally a pair of upper and lower parallel guides having axis lines almost parallel to that of a take-up bobbin, below the plate member. The fiber bundle is twisted 90° toward the direction of the axis line of a bobbin by means of the plurality of the conical guides disposed above the plate member, advanced through the pair of the guide rolls disposed below the plate member while passing around the pair of the rolls by turn in a state wherein the widened shape is maintained, and then wound on the bobbin.

However, in the guide apparatus described in the Laid-open Japanese Patent Publication No. Hei 10-330038 mentioned above, any consideration is not given to the width of a fiber bundle having a large fineness. In this patent publication No. Hei 10-330038, the apex angle of the cone guides is proposed to be 45° to 120° and preferably 60° to 90°. However, in this range of the apex angle, there is a fear that a sufficient "length" of a roll surface with which a crosswise portion (a line in the crosswise direction) of a fiber bundle contacts can not be secured when a fiber bundle having a large fineness is wound in a case where accommodation of all traverse mechanisms in a space limited from the arrangement of bobbins in a winding apparatus is intended. In other words, when a sufficient length of the oblique line of a conical guide against the width of a fiber bundle having a large fineness was intended to secure in a case wherein the apex angle of conical guide described above was adopted, the diameter itself of the bottom face of the conical guide becomes large, and thus, there is a fear that all of the traverse mechanisms can not be accommodated in the space of a winding apparatus in which a large number of bobbins are already disposed.

Besides, when the guide apparatus described in the Laid-open Japanese Patent Publication No. Hei 4-119123 mentioned above was adopted, the maintenance of the shape of a fiber bundle at the time of reversal in a traverse and winding of a fiber bundle is excellent compared with the case wherein the guide apparatus described in the Laid-open Japanese Patent Publication No. Hei 10-330038 mentioned above is used. However, since the distance between the guide rolls respectively disposed above and below the fixing stand in the guide apparatus is restricted by design specifications and the distance is short, a large torsional force acts on a fiber bundle at the step of twisting the fiber bundle 90° toward the direction of the axis line of a bobbin between the upper guide roll and the lower guide roll, when the number of filaments in one fiber bundle is increased and thus the width of the fiber bundle was also increased. Accordingly, the shape of the widened fiber bundle comes to be lost.

The present invention was produced for the purpose of solving the conventional problems described above, and an object of the present invention is to provide a guide apparatus with which a fiber bundle, as reinforcement for fiber reinforced composite materials, having a width increased into a tape-like fiber bundle can stably be guided in an untwisted condition, and to provide a winding machine with which a widened fiber bundle can stably be wound on a bobbin while maintaining the untwisted condition, sometimes under a condition wherein the width of the fiber bundle is further increased than that of a fiber bundle at the time of being supplied, by merely installing the guide apparatus to an existing winding machine. Another object of the present invention is to provide a method for making a bobbin of a fiber bundle and a bobbin of a bundle of carbon fibers.

SUMMARY OF THE INVENTION

The subject of the present invention described above can basically be achieved by a guide apparatus for guiding an advancing continuous fiber bundle, which guide apparatus comprises:

a pair of guides both of which are disposed on the passage on which the fiber bundle is advanced and the axis lines of which guides are in a relation such that they are twisted away from each other in a given space, and a parallel guide which is disposed at the downstream side of the pair of the guides on the passage, through which parallel guide the fiber bundle is guided to a bobbin, and the axis line of which parallel guide is parallel to that of a bobbin, the pair of the guides are composed of a flat roll and a conical roll, by the pair of the guides, the fiber bundle is twisted and guided to the parallel guide, and by the parallel guide, the position at which the fiber bundle is wound on the bobbin and the width of the fiber bundle are stabilized.

The pair of the guides of the present invention is composed of a pair of guides axis lines of which are in a relation twisted away from each other in a space. From another aspect, the pair of guides comprises a first guide composed of a flat guide or conical guide, and a second guide composed of a conical guide. The axis line of the flat guide forming the first guide is arranged so as to cross at right angle with the axis line of a bobbin. In this case, the flat guide may be a fixed guide or a flat guide having a rotation mechanism. Besides, the first guide may be a conical fixed guide or a conical roll having a rotation mechanism in addition to the flat guide. In this case, it is necessary that the conical guide or roll is disposed so that the oblique line of the conical guide or roll with which an advancing (or supplied) fiber bundle contacts first crosses at right angle with the axis of a bobbin.

The conical guide used as the second guide is disposed so that the axis line of the guide forms an angle of less than 90° with the axis of a bobbin when viewed through a plane and the axis line of the guide is parallel to the axis line of the first guide when viewed from the direction of the axis line of a bobbin. In any event, an advancing fiber bundle comes to be twisted up to nearly 90° in the distance down to the first guide and the second guide. Further, according to the present invention, a fiber bundle is twisted about 90° in the reverse direction to twist back to the same direction as the direction of the fiber bundle when it was supplied, or twisted further in the same direction to turn 180° thereby turn the fiber bundle upside down as the result, while being widened by means of a parallel guide having the axis line parallel to that of a bobbin, after the fiber bundle was passed through the pair of the guides. Then, the fiber bundle is wound in good order on a bobbin in a state wherein the shape of a widened fiber bundle is stably maintained in either case.

The length of the face where the fiber bundle contact on the first guide is satisfactorily selected according to the fineness and width of a fiber bundle, but the length in the range of 20 mm to 150 mm is preferably used. Further, in a case wherein the first guide is a flat roll having a rotation mechanism, while the diameter of the guide is moved in the direction parallel to the axis line of a bobbin by a traverse mechanism and decided only by the limit in the space for disposing bobbins of a winding machine, it is preferable to make the diameter range from 10 mm to 50 mm. Still further, when a conical guide is used as the first guide, the length of oblique line of the guide with which a fiber bundle contacts first and the axis line of which crosses at right angle with that of a bobbin is desirably 20 mm to 150 mm. In this case, the apex angle of the conical guide is preferably in the range of less than 45° in order to secure the length of the oblique line described above, since the dimensions and shape of the guide are subjected to the constraints of the space in which bobbins of a winding machine are disposed, just as in the case wherein the first guide is a flat roll.

While the conical second guide is disposed so that its axial line forms an angle of less than 90° with the axial line of a bobbin when viewed through a top surface and becomes parallel to the axial line of the first guide when viewed from the axis line of a bobbin, the apex angle of the conical second guide is preferably designed to be less than 45° to secure a sufficient length of the oblique line with which a fiber bundle having a large fineness contacts, from the view point of the space just as in the case wherein the first guide is a conical guide. That is, the dimensions of the conical second guide are preferably 10 to 50 mm, more desirably 20 to 40 mm for the bottom face and 20 to 150 mm, more desirably 30 to 120 mm for the oblique line.

Further, according to the structure of winding machine, there exist a type of winding machine in which the rotation axis itself of a bobbin is moved as the diameter of a package increases with the progress of winding, and the other type of winding machine in which the whole bobbin traverse mechanism described below is moved in the radial direction. In the latter case, it is desirable to design the conical guide so as to have a sufficient length of oblique line since the direction of a fiber bundle supplied from the fixed guide roll disposed at an upper portion of a winding machine and described below is varied as the whole bobbin traverse mechanism is moved.

In a pair of guides in which their axis lines are in a relation twisted away from each other in a space, it is sufficient that the question of whether a rotation mechanism should be adopted or not is suitably decided according to its purpose. That is, when a guide having no rotation mechanism is adopted, a fiber bundle is pressed against that guide by winding tension and thus positively opened by the friction to contribute the widening of the fiber bundle. On the other hand, when a guide having a rotation mechanism is adopted, the occurrence of fluffs by the friction is reduced or improved, while the opening action is weak compared with the case wherein a guide having no rotation mechanism is used. Besides, the material and surface condition of the guides described above are not subjected to specific constraints, and thus guides made of a steel, a resin, or a steel coated with a resin can be adopted. With respect to the surface finish, guides having a surface subjected to mirror polishing or satin finish can be adopted. It is satisfactory that the material and surface condition described above are suitably selected according to its purpose, a type of sizing agent containing an epoxy resin as a main component and applied to a fiber bundle at the last stage for manufacturing the fiber bundle, and a desired rigidity or hardness to be imparted to a fiber bundle by a sizing gent.

The parallel guide roll is-serves to further twist a fiber bundle supplied through a conical guide roll disposed above the parallel guide roll toward the direction parallel to that of a bobbin to further widen the fiber bundle into a tape-like one. As the parallel roll, one cylindrical roll is usually employed, but when it is desired to still further widen the fiber bundle, it is possible to use a plurality of parallel guides as described in Laid-open Japanese Patent Publication No. Hei 10-330038 or use a plurality of parallel guide rolls at least one of which has a shape of a large hand drum trunk of which has a curved circumferential surface bulged at its center portion as described in Laid-open Japanese Patent Publication No. 2001-348166.

According to the present invention, it is preferable that a winding machine has a first fixed guide roll having the axis line parallel to that of a bobbin and disposed above the pair of the guides described above, and a fiber bundle supplied from a fiber bundle supplying portion is guided and changed its advancing direction by means of the fixed guide roll described above, further guided by means of a pair of guides axis line of which are in a relation twisted away from each other in a space while passing on the surfaces of the guides by turn as shown in FIGS. 1 and 4, and then advanced toward a bobbin. At this time, since the first guide with which a fiber bundle contacts first in the pair of guides axis lines of which are in a relation twisted away from each other, and which is traversed in parallel to the axis line of a bobbin is disposed so that its axis line crosses at right angle with that of a bobbin, that is, in the direction crossing at right angle with a traverse direction, a fiber bundle is supplied along the circumferential surface of the upper guide described above even if the guide was moved in parallel to the axis of a bobbin, and traversed under a stabilized condition. Thus, a tape-like shape of the fiber bundle can be maintained.

In this case, a fiber bundle is passed around the first fixed guide roll described above as described in FIG. 1, guided through a pair of a first guide and a second guide axis lines of which are in a relation twisted away from each other in a space and a parallel guide having the axis line parallel to that of a bobbin, and then wound on a bobbin. The first guide in the pair of the guides is a flat guide and the second guide is a conical guide. A fiber bundle, for example, a bundle of carbon fibers is twisted by means of the pair of guides and guided to the parallel guide. Then, the position at which the fiber bundle is wound on a bobbin and the width of the fiber bundle are stabilized by means of the parallel guide, and the fiber bundle is wound on a bobbin through a traverse mechanism.

The first fixed guide may have a shape of a hand drum having a curved circumferential surface depressed at its center portion. By taking advantage of such a shape, sway or deviation of a fiber bundle accompanied by the traverse is attenuated even if the distance between the fixed guide roll and a traverse mechanism or a pair of guides axis lines of which are in a relation twisted away from each other in a space was short, and thus the shape of a fiber bundle is not lost.

Winding of the fiber bundle is performed by the rotation of a bobbin which is driven with a torque motor.

Besides, in the winding machine of the present invention, it is possible to further dispose a second fixed guide roll at the upstream side of the hand drum-like first fixed guide roll having a circumferential surface depressed at its center portion, on the passage on which a fiber bundle is supplied, and to select a flat roll as the second fixed guide roll is. By advancing a fiber bundle while passing around the flat second fixed guide roll and the hand drum-like first fixed guide roll alternately as shown in FIG. 1, the fiber bundle is opened and widened by means of the flat roll, and the sway or deviation of the fiber bundle accompanied by the traverse is attenuated by the hand drum-like roll. Thus, the losing of the shape of a fiber bundle does not occur.

In the present invention, it is preferable that the driving means for rotating a bobbin in the winding portion has a mechanism using a dancer roll for controlling winding tension. In this case, it is preferable that a first and a third fixed guide rolls are respectively disposed above the dancer roll and between the dancer roll and a traverse mechanism, and all of the rolls are composed of flat rolls or hand drum-like fixed guide rolls having circumferential surfaces depressed at their center portions. Alternatively, it is possible that a first and a third fixed guide rolls are respectively disposed above the dancer roll and between the dancer roll and a traverse mechanism, and the rolls are composed of a combination of a flat roll and a hand drum-like fixed guide roll having circumferential surfaces depressed at their center portions. It is possible to wind an opened, widened, and flat tape-like fiber bundle on a bobbin even when all of the fixed guide rolls are flat rolls. Besides, when the combination with a hand drum-like guide roll is used, it is possible to attenuate the sway or deviation of a fiber bundle accompanied by a traverse and to maintain the shape of a fiber bundle.

Although the winding machine of the present invention is most suitable when a widened flat tape-like fiber bundle, particularly a bundle comprising a large number of carbon fiber filaments is to be wounded, the winding machine can be applied to various types of fiber bundles as a matter of course.

Figure 1:
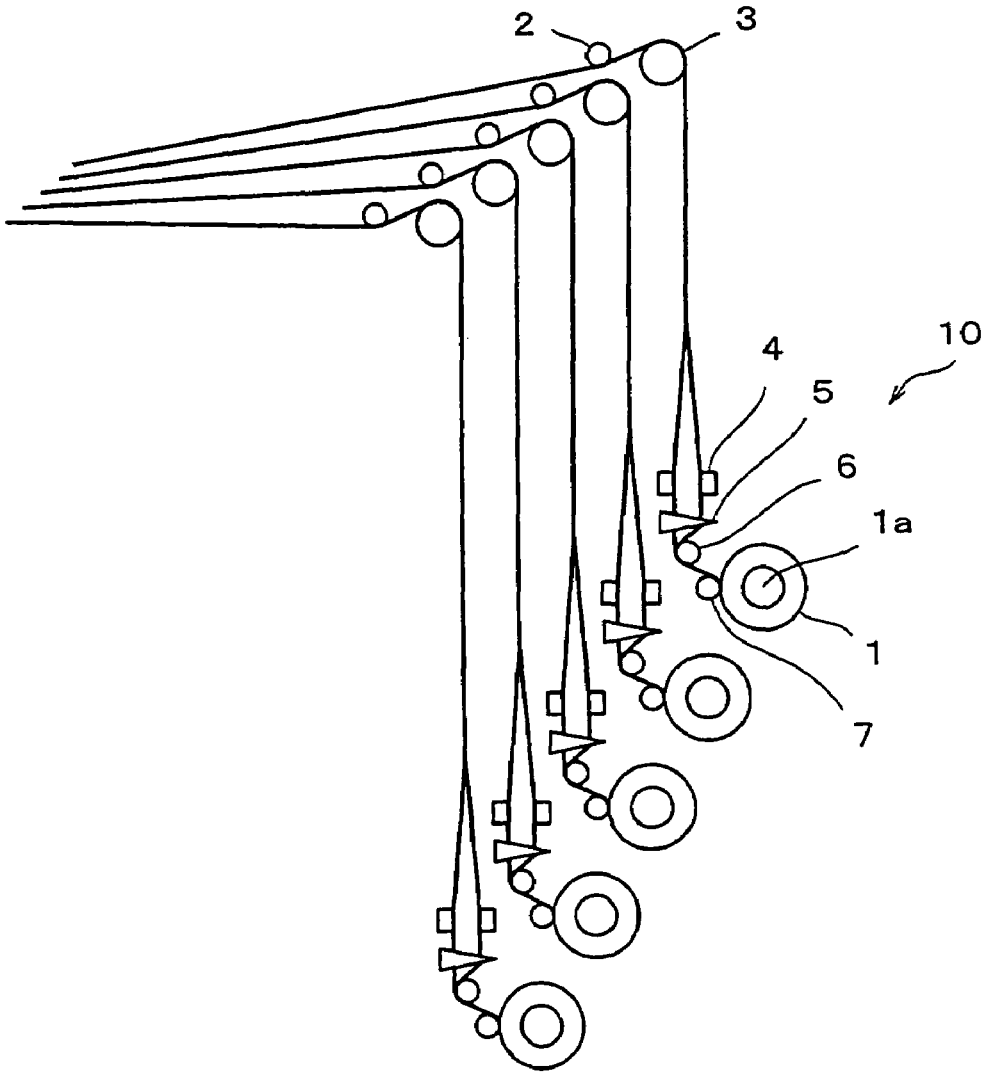
FIG. 1 is a schematic side view for illustrating a state in which a fiber bundle is wound on a bobbin by means of a winding machine which is equipped with a guide apparatus of the present invention and used for winding a continuous fiber bundle.

The meanings of the reference numbers used in the drawings are as follows:

1: bobbin

1*a*: axis line of bobbin

2: upper second fixed guide roll

3: upper first fixed guide roll

4: first guide

4*a*: axis line of first guide

5: second guide

5*a*: axis line of second guide

6: parallel guide roll

7: pressure roll

8: frame

10: guide apparatus

11: common upper fixed guide roll (second fixed guide roll)

12: dancer roll

13: third (intermediate) fixed guide roll

θ: angle formed between axial line 5*a* of second guide and axis line 1*a* of bobbin

DESCRIPTION OF THE PREFERRED EMBODIMENT(S) OF THE INVENTION

Now, the preferred embodiments of the present invention are specifically described with reference to the drawings. As carbon fibers, (a) PAN type carbon fibers obtained by heating acrylic fibers, as starting material, in an air environment to make the fibers flame resistant and then further heating the resulting flame resistant fibers in a nitrogen gas to carbonize, and (b) pitch type carbon fibers obtained by using, as a starting material, a pitch derived, for example, from a petroleum have been known, and the present invention can be applied when winding either type of carbon fibers on a bobbin.

As disclosed, for example, in Japanese Patent Publication No. Hei 6-65787, a tape-like bundle of carbon fibers is obtained by impregnating a bundle of carbon fibers with a sizing agent and then heating the impregnated fiber bundle with a heated roll to dry. The bundle of carbon fibers thus obtained is wound on a bobbin by means of a winding apparatus and then supplied to a succeeding step such as a step for preparing a prepreg.

Figure 2:
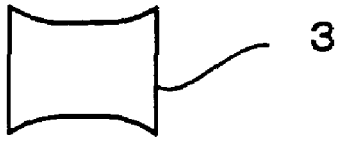
FIG. 2 is a schematic front view for illustrating the arrangement of guide members in a winding machine of the present invention.
Figure 2:
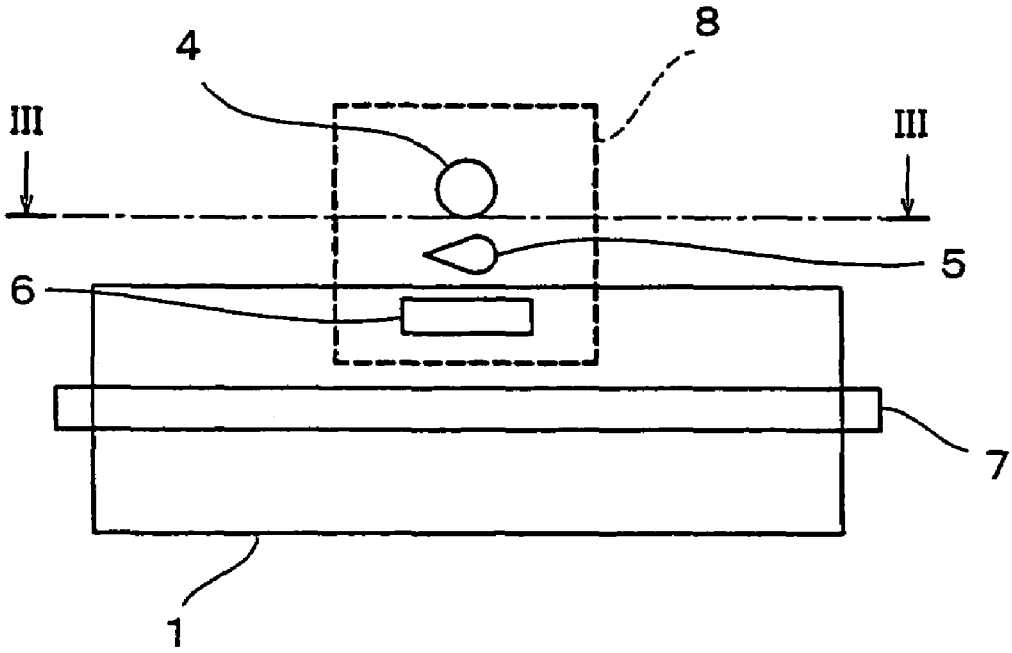
Figure 3:
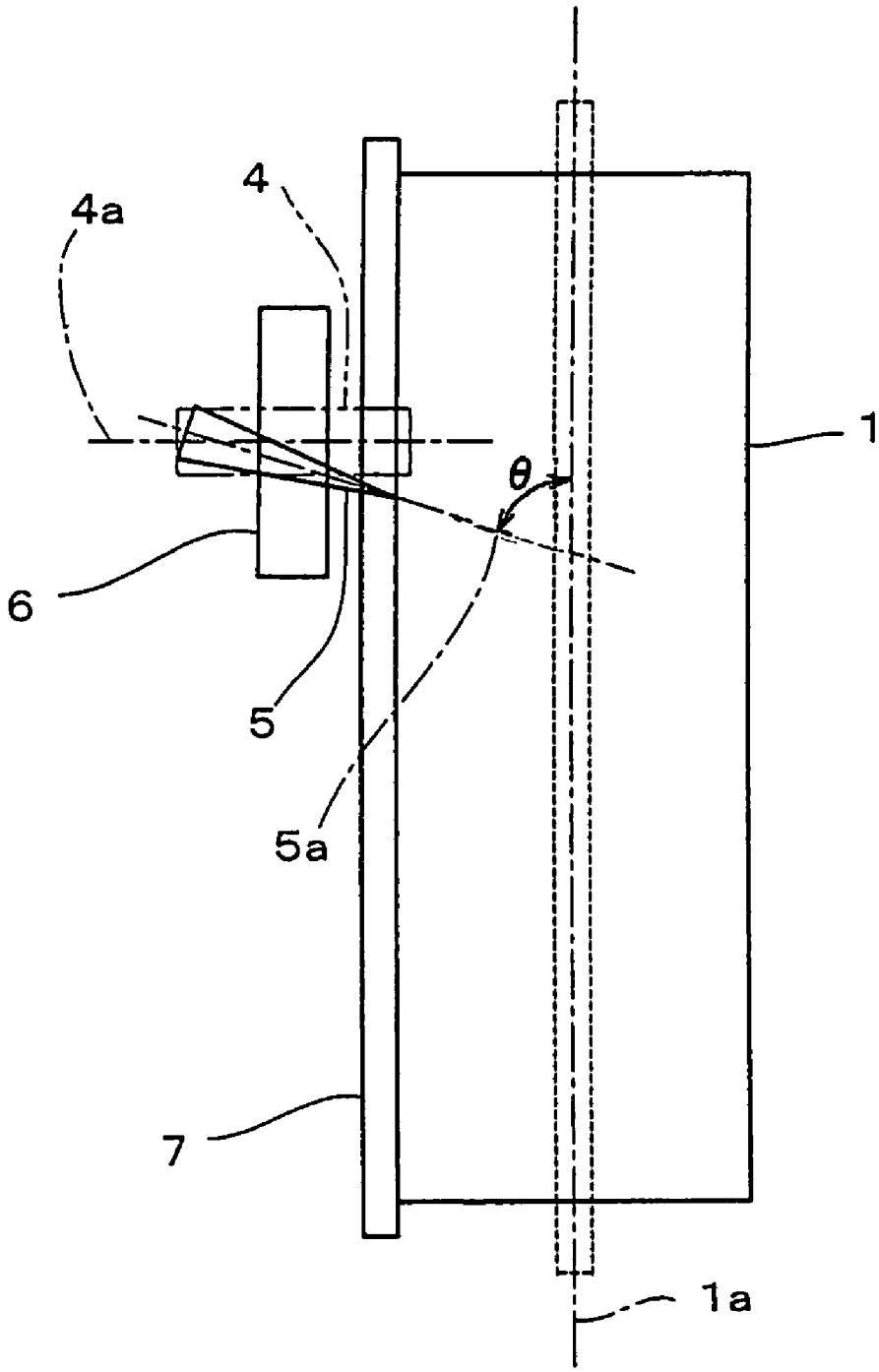
FIG. 3 is a schematic arrow diagram taken on line III-III of FIG. 2.
Figure 4:
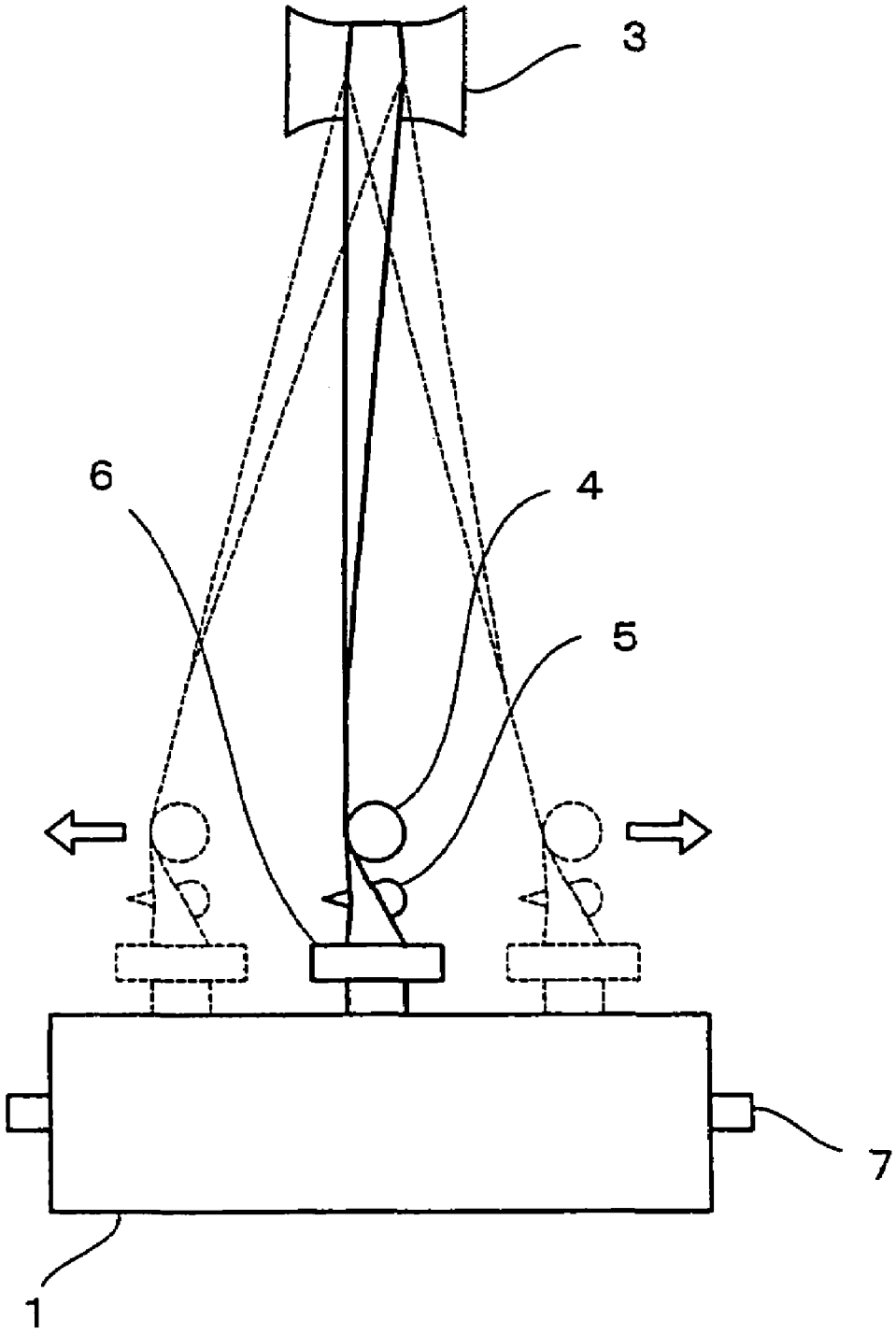
FIG. 4 is a schematic front view for illustrating a state in which a continuous fiber bundle is traversed in a winding machine of the present invention.

FIG. 1 is a schematic side view for illustrating a structure of a winding machine of the present invention in which machine a guide apparatus of the present invention is installed in the guiding portion. The drive for rotating bobbins in the winding portion is performed by means of a torque motor. FIG. 2 is a schematic front view for illustrating especially the arrangement of principal members in the guide apparatus of the present invention. FIG. 3 is a schematic plane view of the guide apparatus as well as a bobbin shown in FIG. 2 taken on line III-III of FIG. 2. In FIG. 3, axis lines are drawn for illustrating the axial directions of the members of the guide apparatus and the bobbin. FIG. 4 is a schematic front view of the guide apparatus and bobbin shown in FIG. 2.

Guide apparatus 10 of the present invention has three guides 4, 5, and 6 each attached to a frame not shown in the drawings. The guide apparatus 10 is installed to a known traverse mechanism which is not shown in the drawing and reciprocatively moved in parallel to axis line 1*a* of bobbin 1 together. A first guide 4 and a second guide 5 of the guide apparatus 10 constitutes a pair of guides. Those guides are disposed so that their axis lines are in a relation twisted away from each other when viewed from above as shown in FIG. 3 and each axis line crosses at right angle with axis line 1*a* of bobbin 1 when viewed from the direction of the axis line of a bobbin. Another guide 6 is composed of a guide roll disposed at the downstream side of the second guide 5 on the passage for supplying a fiber bundle so that its axis line becomes parallel to axis line 1*a* of bobbin 1 described above. (Hereinafter, this guide 6 is referred to as parallel guide.)

The first guide 4 is composed of a flat guide, and this may be a fixed guide or flat roll having a rotation mechanism. As its construction material, any material including a steel applied with a satin plating, applied with a mirror plating, or coated with a resin such as a TEFLON coating can be used. While the first guide 4 may be a conical fixed guide or conical roll having a rotation mechanism other than a flat guide, when a conical guide is adopted, the axis line of the guide is arranged so that a portion of the guide with which an advancing fiber bundle contacts first and which corresponds the oblique line of a cone becomes perpendicular to axis line 1*a* of bobbin 1 as shown in FIG. 2. At this time, while the length of the portion of the first guide 4 with which a fiber bundle contacts depends on the fineness of a fiber bundle or the width of a fiber bundle supplied, the length is usually 20 mm to 100 mm, preferably 30 mm to 80 mm in consideration of the space in which bobbin 1 of a winding machine is disposed when a flat guide is used. The diameter of the guide is preferably 10 mm to 50 mm, more desirably 20 mm to 40 mm from the view point of the space for disposing the bobbin. Further, even when a conical fixed guide or roll is used as the first guide 4, the length of the oblique line where a fiber bundle contacts first is usually 20 mm to 120 mm, preferably 30 mm to 100 mm, and the diameter of the bottom face of the cone is preferably 10 mm to 50 mm, more desirably 20 mm to 40 mm.

The second guide 5 presents a conical shape and is disposed so that its axis line comes to be in a relation twisted away from the axis line of the first guide 4. That is, the second guide 5 is disposed in the direction in which the second guide 5 crosses at right angle with axis line 1*a* of bobbin 1 when viewed from the direction of the axis line 1*a* as will be understood from FIG. 1 and at the same time, the axis line 5*a* of the second guide 5 forms an angle less than 90° with axis line 1*a* of bobbin 1 when viewed from the direction through which a fiber bundle is supplied to the bobbin as shown in FIG. 3. The apex angle of the conical shape is designed to be less than 45°. From the view point of restricted space for disposing bobbin 1, it is preferable to secure a sufficient length of the oblique line, with which a fiber bundle having a large fineness contacts, in a narrow space. That is, the diameter of the bottom face of conical second guide 5 is preferably 10 mm to 50 mm, more desirably 20 mm to 40 mm, and the length of the oblique line is usually 20 mm to 100 mm, preferably 30 mm to 80 mm.

By the pair of the first guide 4 and the second guide 5, and the parallel guide 6 described above, a fiber bundle is twisted about 90° toward the direction to which the bundle is supplied and then twisted back to 0°. Alternatively, in order to further twist the fiber bundle 90° in the same direction, it is preferable that the direction of axis line 5*a* of the second guide 5 and its apex angle are adjusted as described above, and the direction of the oblique line which contacts with the fiber bundle is adjusted so as to form an angle of 30° to 60°, especially 40° to 50° with axis line 1*a* of bobbin 1 as shown in FIG. 3.

The parallel guide 6 is also supported by a supporting means common to the first guide 4 and the second guide 5, and reciprocatively traversed by a traverse mechanism, not shown in the drawings, in the direction parallel to axis line 1*a* of bobbin 1.

This parallel guide 6 further twists a fiber bundle supplied through the second guide 5 composed of a conical roll disposed above the parallel guide 6 to the direction parallel to a bobbin 1 and widen the bundle up to tape-like fiber bundle at the same time. As the parallel guide 6, a single cylindrical roll is used, and its diameter is designed preferably to be 10 mm to 40 mm, more desirably 15 mm to 30 mm from the viewpoint of the space for disposing a bobbin in a winding machine. While the length of the surface of the roll may suitably be decided depending on the total fineness and the width of a fiber bundle, the length of the surface of parallel roll 6 is preferably 20 mm to 100 mm when the fact that the position of a fiber bundle is varied more or less on a circumferential surface of the roll is taken into consideration, and more desirably 30 mm to 80 mm even when a factor of attaching the roll to a traverse mechanism is considered. When it is desired to widen the fiber bundle more, it is possible to use a plurality of parallel guides as described in Laid-open Patent Publication No. Hei 10-330038, or to dispose a plurality of parallel guides and to use a large hand drum-like roll having a curved circumferential surface bulged at its center portion as at least one of the parallel guides as described in Laid-open Japanese Patent Publication No. 2001-348166.

As shown in FIG. 1, a first fixed guide roll 3 and a second fixed guide roll 2 may be disposed in parallel with the axis line 1*a* of the bobbin 1 and above the winding portion.

While a fiber bundle is supplied to a winding portion after impregnated with a sizing agent containing an epoxy resin as a main component and widened by squeezing with nip rolls or contacting with a dry heated roll at a last step in the stage of producing a fiber bundle, the fiber bundle is advanced to a bobbin after passing alternately around the second fixed guide roll 2 and the first fixed guide roll 3 both disposed above the winding portion, and then further passing on the first guide 4 and the second guide 5 axial lines of which are in a relation twisted away from each other in a space by turn as shown in FIG. 1. At this time, the first guide 4 and the second guide 5 are traversed in parallel to axis line 1*a* of bobbin 1, Besides, since the first guide 4 with which a fiber bundle contacts ahead of the second guide 5 is a flat guide and arranged so that the axis line of the guide 4 becomes perpendicular to the axis line of a bobbin, that is, in the direction which crosses at right angle with the direction of traverse, even if the guide was moved in parallel to the axis of a bobbin, the fiber bundle is supplied along the circumferential surface of the roll of the first guide 4 and traversed in a stabilized state. Thus, the tape-like shape of the fiber bundle can be maintained. In this connection, a single parallel guide roll 6 is used in the embodiments shown in FIGS. 5 and 6, it is possible to adopt a pair of two parallel guides disposed in parallel. In this case, a fiber bundle is traversed more stably since it is possible to reciprocatively move a fiber bundle while securely following the guide even at the turn back point of the traverse.

Further, as a first fixed guide roll 3, a roll having a curved circumferential surface depressed at its center portion as shown in FIG. 2 and FIG. 4 is used. By adopting a roll having such a shape, the sway or deviation of a fiber bundle between the first fixed guide roll 3 and a traverse mechanism not shown in the drawings caused accompanied by the traverse is attenuated and a case where the shape of the fiber bundle is lost does not occur even if the distance between the first fixed guide 3 and a pair of a first guide 4 and a second guide 5 axis lines of which are in a relation twisted away from each other was shortened. At this time, as the shape of the circumferential surface, a part of a circular arc is used as it is. Although it depends on the width of a fiber bundle and the distance down to the first guide 4, the radius of the circular arc is preferably 30 mm to 150 mm and more desirably 40 mm to 120 mm. Besides, although the diameter of the first fixed guide roll 3 is not subjected to any constraints, its diameter is preferably larger than 25 mm at the most depressed portion, from the view point of preventing fluffs of a fiber bundle from adhering around the guide roll.

In a winding machine of the present invention, a second fixed guide roll 2 may be disposed at further upstream side of the hand drum-like first fixed guide roll 3 having a circumferential surface depressed at its center portion, on the passage on which a fiber bundle is supplied, and the fact that the second fixed guide roll 2 is a flat roll is a feature in an embodiment of the winding machine of the present invention. Although the dimension of the flat roll is not subjected to any constraints, it is preferable to design the diameter of the roll to be larger than 25 mm, from the view point of preventing fluffs of a fiber bundle from adhering around the guide roll.

By passing a fiber bundle around the flat second fixed guide roll 2 and the hand drum-like first guide roll 3 alternately as shown in FIG. 1, the fiber bundle is opened and widened at the same time by the flat roll, and the sway or deviation of the fiber bundle accompanied by the traverse is attenuated by the hand drum-like roll. Thus, a case wherein the shape of the fiber bundle is lost does not occur.

Figure 5:
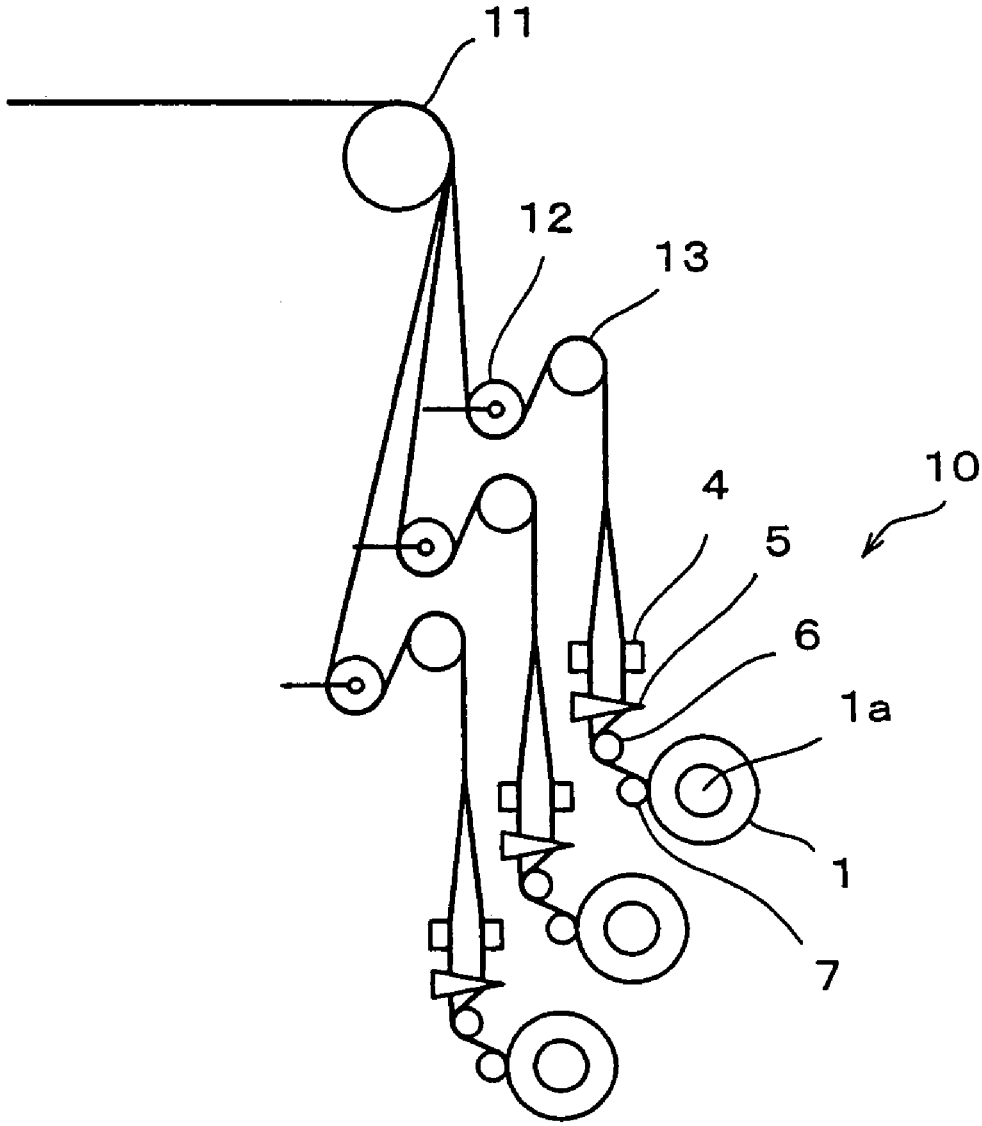
FIG. 5 is a schematic side view for illustrating another embodiment of a winding machine of the present invention used for winding a continuous fiber bundle.
Figure 6:
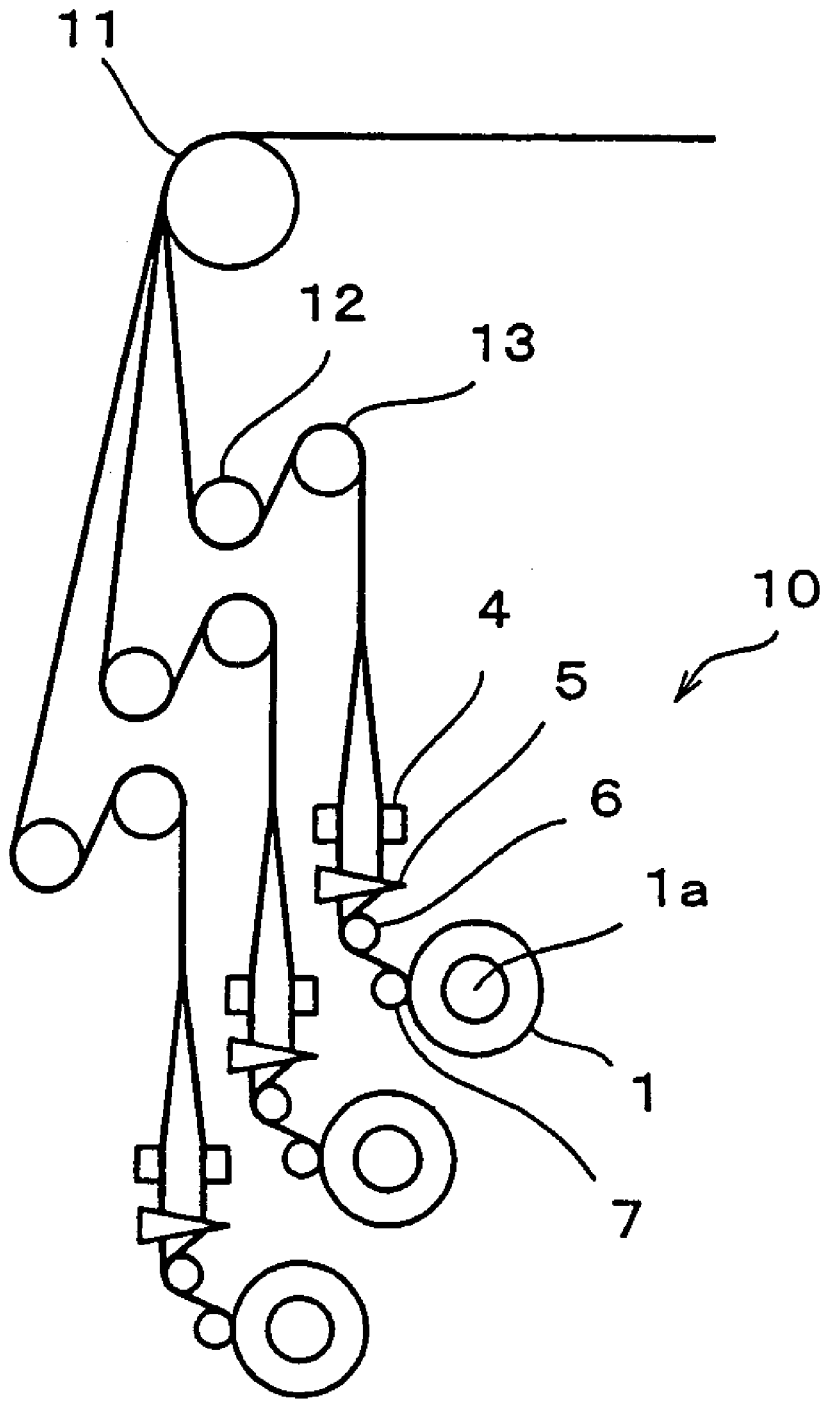
FIG. 6 is a schematic side view for illustrating still another embodiment of a winding machine of the present invention used for winding a continuous fiber bundle.

FIG. 5 shows a schematic side view of a winding machine of the present invention in which guide apparatus 10 of the present invention is installed, dancer roll 12 is disposed between the first fixed guide roll 11 (common upper fixed guide roll) and the guide apparatus 10 mentioned above, and a system (or mechanism) for controlling the tension of a fiber bundle by controlling the rotation of bobbin 1 based on the quantity of the displacement of dancer roll 12 is provided. In this connection, the winding machine shown in FIG. 5 does not have a plurality of the first fixed guide rolls 3 disposed for each of the guide apparatuses 10 like the winding machine shown in FIG. 1, but has a single guide roll 11 instead, used for every guide apparatuses 10 in common.

In the winding machine shown in FIG. 5, a third fixed guide roll 13 is disposed on the passage of a fiber bundle so that the fiber bundle is guided while passing on the lower side of the circumferential surface of the dancer roll 12 between the first fixed guide roll 11 and the third fixed guide roll 13. The winding machine shown in FIG. 5 has substantially the same structure as that of winding machine shown in FIG. 1 except the first fixed guide roll 11, dancer roll 12, and the third fixed guide roll 13. A plurality of fiber bundles are supplied to the first fixed guide roll 11 composed of a single roll from which each of the fiber bundles are advanced through dancer roll 12 so as to be wound on bobbins.

The dancer roll 12 shown in FIG. 5 can be swung like a pendulum by itself, and the swing is caused by the balance between the tension of a fiber bundle and the sum of the dead weight of dancer roll 12 and the added load not shown in the drawings. In this connection, dancer roll 12 has a tension controlling mechanism (not shown in the drawings) by PID method or the like so as to control the winding tension of bobbin 1 according to the width of swing, that is, the quantity of the displacement of dancer roll 12. For instance, the tension is controlled in such a way that when the tension of a fiber bundle was reduced and thus the position of dancer roll 12 was lowered, the rotational speed of the axis of bobbin 1 is increased so that the tension of the fiber bundle becomes a prescribed value. Among the guide rolls shown in FIG. 5, all of the first fixed guide roll 11, dancer roll 12, and the third fixed guide roll described above may be composed of flat rolls. Alternatively, even when a roll is a hand drum-like roll having a circumferential surface depressed at its center portion, it is possible to use such a hand-like roll in combination with a flat roll.

As the first fixed guide roll 11, while a single cylindrical roll may be used, its diameter is usually 20 mm to 120 mm, preferably 30 mm to 100 mm from the view point of the space for disposing bobbins 1 in a winding machine even in this case. Further, the length of the surface of the roll is satisfactorily decided from the total fineness, width, and number of filaments of a fiber bundle to be supplied. However, when all of dancer roll 12 and the third guide roll 13 are composed of flat rolls, a fact that the position of a fiber bundle is varied in some extent on the circumferential surface of a roll accompanied by the traverse should be taken into consideration. When dancer roll 12 and the third fixed guide roll 13 are composed of flat rolls, the diameters of these rolls are preferably 10 mm to 40 mm from the view point of the space for disposing bobbin 1 in a winding machine. Also, in this case, even the length of the surface of a roll is necessary to be decided in consideration of the fact that the position of a fiber bundle is varied on the circumferential surface of a bobbin.

When hand drum-like rolls each having a curved circumferential surface depressed at its center portion are used as dancer roll 12 and the third guide roll 13 in order to attenuate the sway or deviation of a fiber bundle, a part of a circular arc is used as the shape of the curved surface. While the radius dimension of the arc is affected by the width of a fiber bundle and the distance down to the first guide 4 in the pair of the first guide 4 and the second guide 5, the radium dimension is preferably 30 mm to 150 mm, more desirably 40 mm to 120 mm. Besides, while the diameter of the roll is not subjected to any constraints, it is preferably more than 25 mm at the most depressed portion, from the view point of preventing fluffs from adhering on the surface of a roll. Such an arrangement of these guide rolls in a winding machine as in the embodiment shown in FIG. 6 causes no trouble at all, and desired effects can be obtained.

Next, specific examples of the present invention are described below.

EXAMPLE 1

A guide apparatus (10) as shown in FIG. 1 and FIG. 2 was manufactured and used as guide in a winding machine type KTW-C manufactured by KAMITSU SEISAKUSHO LTD. As the drive for rotating a bobbin (1) in the winding portion, a torque motor drive method was employed. At this time, a cylindrical flat guide attached to a frame 8 was used as first guide (4), the length of the portion of the roll with which a fiber bundle contacts was decided to be 60 mm, and the diameter of the roll was decided to be 25 mm. As second guide (5), a conical fixed guide having an apex angle of 15° and a height of cone of 60 mm was used, and the second guide (5) was arranged so that the angle (0) formed with axis line 1*a* of bobbin 1 becomes 57.5° as shown in FIG. 3. The steel surfaces of both of these first guide (4) and second guide (5) were applied with satin plating. As parallel guide roll (6), a steel roll having a diameter of 15 mm, a length of roll surface (roll width) of 75 mm, and a roll surface applied with satin plating was used. As upper first fixed guide roll (2) to be positioned in an upper portion of a winding portion, a flat roll having a diameter of 40 mm and a length of 80 mm was used. As upper second fixed guide roll (3), a hand drum-like roll having a curved circumferential surface depressed at its center portion was used, and the roll was designed so that the curved surface had a part of a circular arc having a radius of 45 mm, the diameter was 50 mm at the most depressed portion, and the roll length was 50 mm.

Such guide apparatus (10) was installed to the winding machine described above, and a bundle of carbon fibers was wound on a take-up bobbin made of paper (paper tube) in the winding portion. As the paper tube, one having a diameter of 80 mm and a length of 305 mm was used, and the width of traverse was adjusted to 254 mm. As the bundle of carbon fibers, one comprising 50,000 filaments having a single fiber diameter of 7 μm and formed into a tape-like fiber bundle having a width of 13 mm was used.

The bundle of carbon fibers was supplied to the winding portion at a speed of 4 m/min and wound 2,000 m on the paper tube. Thereafter, the bundle of carbon fibers was pulled out from the paper tube at a speed of 10 m/min and subjected to drum wind evaluation. When the width of the fiber bundle for 1,000 m was actually determined every 1 second by using a CCD camera, no substantial decrease in the width of the fiber bundle was found not only at the center portion but also at an end portion of the paper tube, indicating an excellent stability of widened shape of the fiber bundle. The width of the fiber bundle was varied only in the range of 19 mm (narrowest) to 21 mm (widest) and CV value was less than 2.5%.

EXAMPLE 2

A bundle of carbon fibers comprising 48,000 filaments having a single fiber diameter of 7 μm was wound on a bobbin by using a winding machine manufactured by Bouligny Company. At this time, the same guide apparatus (10) as that used in Example 1 was used with the exception that the guides surface of which were coated with a resin were used as the first guide (4) and the second guide (5).

In the Example, as the second fixed guide roll (11), a roll having a diameter of 76.2 mm was used. The length of this roll was decided to be 127 mm and was used in consideration of the fact that 4 fiber bundles were to be supplied. As dancer roll (12) and the third fixed guide roll (13), flat rolls having a diameter of 50.8 mm and a roll length of 50.5 mm were used equally. By using a winding machine equipped with such guide rolls, a bundle of carbon fibers was wound on a take-up roll made of paper (paper tube). As the paper tube, a tube having an outer diameter of 82 mm and a length of 305 mm was used, and the width of traverse was adjusted to 252.4 mm.

The bundle of carbon fibers was supplied to the winding portion at a speed of 7 m/min and wound 2,000 m on the paper tube described above. Thereafter, the bundle of carbon fibers was pulled out from the paper tube at a speed of 10 m/min and subjected to drum wind evaluation. When the width of the fiber bundle for 1,000 m was actually determined every 1 second by using a CCD camera, no substantial decrease in the width of the fiber bundle was found not only at the center portion but also at an end portion of the paper tube, indicating an excellent stability of widened shape of the fiber bundle. The width of the fiber bundle was varied only in the range of 18 mm (narrowest) to 20 mm (widest) and CV value was less than 2.5%.

As described above in detail, in preferable embodiments of the guide apparatus of the present invention, which apparatuses are used in a winding machine for winding a continuous fiber bundle, for example, a bundle of carbon fibers, two pairs of guide rolls and guide members (total four) shapes of which guide rolls and guide members in each pair are different from each other, are disposed on a guide stand to be traversed; the traverse motion is cancelled out by the former first and second fixed guide rolls; and the fiber bundle is stably twisted 90° toward the direction of the axis line of a bobbin while maintaining the shape of the fiber bundle by the succeeding pair of the first and the second guides; and the fiber bundle can be supplied along a circumferential direction of the bobbin by the last parallel guide and a press roll. As the result, a fiber bundle widened into a tape-like shape can be wound on a bobbin in a stabilized shape.

Further, according to the present invention, it becomes possible to produce a carbon fiber prepreg of a light stuff and to produce a molded product by drum wind or filament wind, since a fiber bundle pulled out from a roll wound on a bobbin in the winding portion has an increased stabilized width.

The invention claimed is:

1. A guide apparatus for guiding an advancing continuous fiber bundle used when winding the fiber bundle on a bobbin, which comprises:

a first guide and a second guide, each of said guides being disposed in a passage through which the fiber bundle is advanced, wherein axis lines of the first and second guides are twisted away from each other in a space, and a parallel guide, which is disposed at a downstream side of the first and second guides on the passage, through which the fiber bundle is guided to the bobbin and which has an axis line parallel to that of the bobbin, a first fixed guide roll, which is disposed at an upstream side of the first guide on the passage, and which supplies the fiber bundle as a state that a direction of a width of the fiber bundle is parallel to a bobbin axis, the first guide comprising a substantially flat guide, which guides the fiber bundle in a twisted state, and which has the axis line thereof arranged so as to cross substantially at a right angle to that of the bobbin, between the first fixed guide roll and the first guide, the direction of the width of the fiber bundle is twisted from a state that the direction of the width of the fiber bundle is parallel to the bobbin axis to a state on the first guide that the direction of the width of the fiber bundle is at a right angle to the bobbin axis, the second guide comprising a conical guide on which the fiber bundle is advanced in a twisted state, on said parallel guide, the fiber bundle being twisted back to the same direction as the direction of the fiber bundle when being supplied from the first fixed guide roll, or being twisted further in the same direction to thereby turn the fiber bundle upside down, wherein the position at which the fiber bundle is wound on the bobbin and the width of the fiber bundle are stabilized by means of said parallel guide.

2. The guide apparatus according to claim 1 wherein the second guide is disposed so that the axis line thereof has an inclination angle of less than 90° toward the axis line of the bobbin.

3. The guide apparatus according to claim 1 which comprises a common supporting means and a traverse mechanism wherein the pair of first and second guides and the parallel guide are supported by means of said common supporting means so as to move in linkage, and the supporting means is reciprocatively moved in the direction parallel to the axis line of the bobbin by means of said traverse mechanism along nearly the whole length of the bobbin.

4. A winding machine for winding an advancing continuous fiber bundle on a bobbin, which comprises:

a guide portion comprising the guide apparatus defined in claim 1, and a winding portion, wherein an axis line of the first fixed guide roll in the guide portion is disposed so as to be parallel to the axis line of the bobbin.

5. The winding machine according to claim 4 wherein the first fixed guide roll is disposed d for a unit of bobbin, and the first fixed guide roll has a curved circumferential surface whose diameter is progressively reduced toward a center portion thereof.

6. The winding machine according to claim 5 which comprises a second fixed guide roll further disposed in parallel to the first fixed guide roll between the first fixed guide roll on the passage for advancing the continuous fiber bundle and the first guide, and wherein the second guide is disposed in the guide apparatus, the second fixed guide roll comprising a flat roll.

7. The winding machine according to claim 4 which comprises a third fixed guide roll further disposed between the first fixed guide roll and the first guide, and a dancer roll disposed between the first fixed guide roll and the third fixed guide roll, wherein the first and the third guide rolls comprise flat rolls or have curved circumferential surfaces whose diameters are progressively reduced toward center portions thereof.

8. The winding machine according to claim 7 which comprises means for controlling the tension of the continuous fiber bundle based on the displacement of the dancer roll for controlling rotational driving of the bobbin, and wherein each of the first and the third fixed guide rolls comprise flat rolls or have curved circumferential surfaces whose diameters are progressively reduced toward the center portions thereof.

9. The winding machine according to claim 7 which comprises means for controlling the tension of the continuous fiber bundle based on the displacement of the dancer roll for controlling rotational driving of the bobbin, and the first and the third fixed guide rolls comprise a flat roll and a combination with a roll having a curved circumferential surface whose diameter is progressively reduced toward a center portion thereof.

10. A winding machine for winding a plurality of advancing continuous fiber bundles respectively on a plurality of bobbins, which comprises:

a guide portion comprising a plurality of the guide apparatuses defined in claim 1, and a winding portion comprising plurality of bobbins, wherein in the guide portion, the first fixed guide roll comprises a single flat roll, and the first guide, the second guide and the parallel guide respectively comprise a plurality of rolls, and the plurality of continuous fiber bundles are guided to the first fixed guide roll so as to be guided simultaneously to each of the plurality of the first guide, the second guide and the parallel guide.

11. A method for making a bobbin of a continuous fiber bundle, wherein a plurality of continuous fiber bundles advancing on a passage are guided by guides and wound on the bobbin, which comprises:

guiding the fiber bundle sequentially by a first guide and a second guide being disposed in a passage through which the fiber bundle is advanced, wherein axis lines of the first and second guides are twisted away from each other in a space, guiding the fiber bundle by a parallel guide, which is disposed at a downstream side of the first and second guides on the passage and which has an axis line parallel to that of the bobbin, guiding the fiber bundle by a first fixed guide roll, which is disposed at an upstream side of the first guide on the passage, and supplying the fiber bundle to the first and second guides, supplying the fiber bundle to the first and second guides in a condition that an axis line of a first fixed guide roll is parallel to an axis line of a bobbin axis, guiding the fiber bundle in a twisted sate by the first guide, the first guide comprising a substantially flat guide, which has an axis line thereof arranged so as to cross substantially at a right angle to the axis line of the bobbin, between the fixed guide roll and the first guide, twisting the direction of the width of the fiber bundle, from a state that the direction of the width of the fiber bundle is parallel to the bobbin axis to a state on the first guide that the direction of the width of the fiber bundle is at a right angle to the bobbin axis, the second guide comprising a conical guide, twisting back to the fiber bundle being advanced in a twisted state on said parallel guide to the same direction as the direction of the fiber bundle when being supplied from the first fixed guide roll, or twisting further in the same direction so as to turn the fiber bundle upside down, and stabilizing the position at which the fiber bundle is wound on the bobbin and the width of the fiber bundle, by means of a parallel guide.

12. The method for making a bobbin of a continuous fiber bundle according to claim 11 which comprises forming the continuous fiber bundle so as to have 12,000 to 150,000 filaments of carbon fiber.

13. A carbon fiber bobbin obtained by the method defined in claim 11.

14. A guide apparatus for guiding an advancing continuous fiber bundle used when winding the fiber bundle on a bobbin, which comprises:

a first guide and a second guide, each of said guides being disposed on a passage on which the fiber bundle is advanced, wherein the axis lines of the guides are twisted away from each other in a space, a parallel guide, which is disposed at a downstream side of the pair of the guides on the passage, through which the fiber bundle is guided to the bobbin, and which has the axis line parallel to that of the bobbin, the first guide comprising a conical guide on which the fiber bundle is advanced in a twisted state, and which is disposed such that an oblique line with which the fiber bundle contacts first crosses at right angle to the axis line of the bobbin, and the second guide comprising a conical guide on which the fiber bundle is advanced in a twisted state, on the parallel guide, the fiber bundle being twisted back to the same direction as the direction of the fiber bundle when it is being supplied, or being twisted further in the same direction thereby turning the fiber bundle upside down, wherein the position at which the fiber bundle is wound on the bobbin and the width of the fiber bundle is stabilized by means of the parallel guide.

* * * * *